US005524826A

United States Patent [19]

Mueller et al.

[11] Patent Number: 5,524,826

[45] Date of Patent: Jun. 11, 1996

[54] FUEL INJECTION DEVICE FOR INTERNAL COMBUSTION ENGINES

[75] Inventors: Peter Mueller, Hallein; Jaroslaw Hlousek, Golling, both of Austria

[73] Assignee: Robert Bosch GmbH, Stuttgart, Germany

[21] Appl. No.: 339,682

[22] Filed: Nov. 14, 1994

[30] Foreign Application Priority Data

Dec. 7, 1993 [DE] Germany ..... 43 41 545.8

[51] Int. Cl.[6] ..... F02M 47/02

[52] U.S. Cl. ..... 239/88; 239/127; 239/533.9; 239/585.1

[58] Field of Search ..... 239/124, 127, 239/96, 88, 533.3, 533.9, 585.1

[56] References Cited

U.S. PATENT DOCUMENTS

| | | | |
|---|---|---|---|
| 3,606,158 | 11/1969 | Pritchard | 239/124 |
| 3,802,626 | 4/1974 | Regneault et al. | 239/96 |
| 4,572,433 | 2/1986 | Deckard | 239/96 X |
| 4,605,166 | 8/1986 | Kelly | 239/90 |

FOREIGN PATENT DOCUMENTS

| | | | |
|---|---|---|---|
| 1004217 | 3/1947 | France | 239/124 |
| 264147 | 2/1990 | Japan | 239/124 |
| 74862 | 1/1954 | Netherlands | 239/124 |

*Primary Examiner*—Kevin P. Weldon

*Attorney, Agent, or Firm*—Edwin E. Greigg; Ronald E. Greigg

[57] ABSTRACT

A fuel injection device for internal combustion engines having a high pressure accumulation chamber, which can be filled by a high pressure fuel pump and from which high pressure lines lead to the individual injection valves. Control valves for controlling the high pressure injection at the injection valves, as well as an additional pressure storage chamber between these control valves and the high pressure accumulation chamber are inserted in the individual high pressure lines. In order to be able to carry out a shaping of the course of injection at the injection valve, the control valve has a hydraulic throttle segment disposed at an additional collar on the valve member as well as a damping chamber formed between the collar and a flat valve seat, whose throttled relief delays the opening motion of the valve member at the onset of injection.

9 Claims, 1 Drawing Sheet

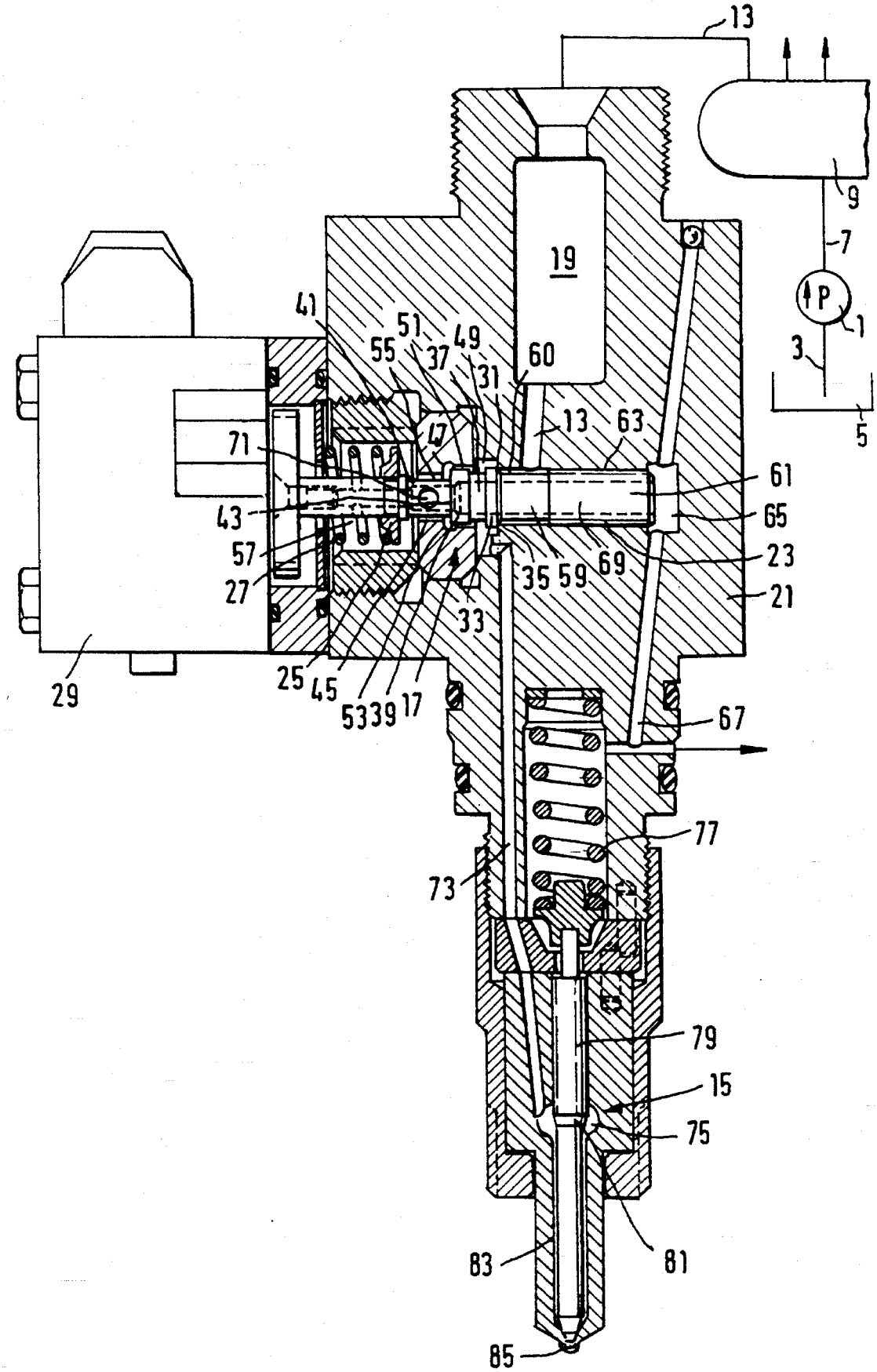
13
9
7
P
1
3
5
19
41
51
55
37
49
31
60
13
63
47
71
61
43
65
57
23
27
35
59
69
21
33
29
25
45
53
39
17
67
77
73
79
15
75
83
81
85

FUEL INJECTION DEVICE FOR INTERNAL COMBUSTION ENGINES

BACKGROUND OF THE INVENTION

The invention is based on a fuel injection device for internal combustion engines. In known fuel injection devices of this kind, a high pressure fuel pump supplies fuel from a low pressure chamber to a high pressure accumulation chamber, which communicates via high pressure lines with the individual injection valves, which protrude into the combustion chamber of the internal combustion engine to be fed; this common pressure storage system is maintained at a determined pressure by a pressure control device. To control the injection times and injection quantities at the injection valves by its opening and closing, one electrically actuated control valve is inserted into each high pressure line of each injection valve. Therefore the injection valves control the high pressure fuel injection at the injection valve.

The control valves at the injection valves are embodied as magnet valves, which at the onset of injection open up the communication between the high pressure line and the injection valve and close it off again at the end of injection.

The control valves in the known fuel injection devices have the disadvantage, though, that they unblock the entire opening cross section immediately at the onset of injection, so that at the very onset of injection, a large quantity of fuel reaches the combustion chamber of the engine to be fed, which leads in a known manner to high pressure peaks at the start of combustion. Furthermore, the known fuel injection devices have the disadvantage that their valve members, when in the open position, are acted upon by high feed pressure on one side so that great adjusting forces are required to close the control valves at the end of injection, which can only be achieved with large adjusting magnets or restoring springs that require a lot of space.

Consequently, with the known fuel injection devices, it is not adequately possible to carry out a shaping of the course of injection at the injection valve.

OBJECT AND SUMMARY OF THE INVENTION

The fuel injection device according to the invention has the advantage over the prior art that the course of injection can be shaped, particularly at the onset and end of injection, by the embodiment of the control valve.

This is achieved in a structurally simple manner by means of the disposition of a damping chamber which is formed between the flat valve sealing face on the collar and the flat valve seat that cooperates with it when the flat seat valve is open. This damping chamber can communicate via a throttle segment with a relief chamber and can also be permanently connected to the pressure line leading to the pressure chamber that communicates with the injection valve. The throttled flow of fuel out of the damping chamber makes possible a delayed opening motion of the valve member at the conical valve seat at the onset of injection, which opens the communication between high pressure line and injection valve; this delay can be adjusted via the dimensioning of the throttle cross section in the relief conduit. Moreover at the onset of injection, when the flat seat valve is not yet closed, a small portion of the feed quantity can flow out into the relief conduit via the throttle cross section at the circumference face of the collar, which likewise contributes to a reduction of the initial injection pressure and consequently of the injection quantity at the onset of injection.

The end of injection can be influenced via the design of the cross section of the throttle provided on the collar of the flat valve seat; the quantity flowing out is at least so great that a rapid pressure decrease in the injection valve to below the injection pressure is guaranteed and consequently a reliable closing is also assured. A further advantage is achieved by means of the disconnection of the injection valve from the high system pressure in the high pressure line; the outflow quantity and consequently the residual pressure remaining at the valve member can be adjusted via the throttle cross section at the collar of the valve member.

It is advantageously possible to achieve a pressure balancing at the valve member of the control valve, both when communication is open between the high pressure line and injection valve and when the control valve is closed, by means of the disposition of an annular groove between the annular rib and the collar on the valve member and by means of the design of this groove having the same diameter as the second annular groove adjoining the other side of the annular rib as well as having the same diameter as the annular rib and collar, which are identical in their outer diameter; this pressure balancing considerably reduces the required adjusting forces of the control valve.

A further advantage is achieved by means of the disposition of an additional pressure storage chamber at each injection valve, via whose design the course of injection during the injection process can be shaped.

The invention will be better understood and further objects and advantages thereof will become more apparent from the ensuing detailed description of a preferred embodiment taken in conjunction with the drawing.

BRIEF DESCRIPTION OF THE DRAWING

The sole drawing FIGURE is a schematic representation of the fuel injection device, in a longitudinal section through the control valve and the injection valve.

DESCRIPTION OF THE PREFERRED EMBODIMENT

In the fuel injection device shown in the drawing, a high pressure fuel pump 1 communicates on the suction side with a low pressure chamber 5, which is filled with fuel, via a fuel supply line 3, and communicates on the pressure side with a high pressure accumulation chamber 9 via a supply line 7. High pressure lines 13 lead from the high pressure accumulation chamber 9 to the individual injection valves 15, which protrude into the combustion chamber of the internal combustion engine to be fed. To control the injection event, an electric control valve 17 is inserted at each injection valve 15 in the respective high pressure line 13. Furthermore, an additional pressure storage chamber 19 is provided in each high pressure line 13 between the high pressure accumulation chamber 9 and the control valve 17, which pressure storage chamber 19 is integrated into a housing 21 of the control valve 17.

The control valve is embodied as a 3/2-way valve, whose pistonlike valve member 23 is actuated by an adjusting magnet 29 which acts on its one face end in opposition to a pressure spring, which is supported between the housing 21 and a spring plate 25 on the valve member 23.

The pistonlike valve member 23 has two axial sealing faces remote from one another, of which a first conical sealing face 31 is disposed on an annular rib 33 and cooperates with a conical valve seat 35. A first annular groove 37 adjoins the valve member 23 on a side of the annular rib 33 remote from the conical valve sealing face 31, which groove is defined on its side remote from the annular rib 33 by a collar 39. The remaining axial annular face on the side of the collar 39 oriented toward the piston shank 41 constitutes a second, flat sealing face 43 on the valve member 23, which sealing face cooperates with a flat valve seat 47 that encompasses a bore 45. The collar 39 and the annular rib 33 are disposed in a pressure chamber 49, which is defined by the conical valve seat 35 and the flat valve seat 47 and which is embodied so that in the region of the collar 39 on the valve member 23 it has only a slight play between it and the circumferential face of the collar 39, and thus constitutes a throttle segment 51 for the fuel flowing from the pressure chamber 49 toward the flat valve seat 47. When the flat seat valve is open, a damping chamber 53 is formed adjoining this throttle segment 51 between the flat sealing face 43 on the collar 39 and the flat valve seat 47, which can communicate via a relief conduit 55 with a spring chamber 57, which contains the pressure spring 27. This relief conduit 55 is constituted by the play remaining between the wall of the bore 45 and the piston shaft 41 guided in it; the flow cross section of the relief conduit 55 is embodied as small enough that the fuel flowing through is throttled; this throttling downstream of the throttle segment 51 can also take place directly at the flat valve seat 47.

A second annular groove 59 on the valve member 23 adjoins the end of the conical valve sealing face 31 remote from the annular rib 33, which groove, together with the wall of a guide bore 63 constitutes an annular chamber 60, into which the high pressure line 13 feeds. The second annular groove 59, which has the same diameter as the first annular groove 37, is defined on its end remote from the annular rib 33 by a guide piston part 61, which is sealingly guided in the guide bore 63 and which defines a relief chamber 65 with its face end remote from the annular groove 59, which chamber 65 communicates with the low pressure chamber 5 via a return line 67. A through bore 69 is provided in the valve member 23, which bore is intersected by a cross bore 71 in the region of the piston shank 41 and via which fuel can flow out of the relief conduit 55 into the relief chamber 65.

In order to guarantee a pressure balancing at the valve member 23 in each valve member position of the control valve 17, the outer diameter of the collar 39 is embodied as identical to the diameter of the guide piston part 61.

The injection valve 15 disposed perpendicular to the axis of the valve member 23, in a known manner, has a pistonlike valve member 79, which is acted upon in the closing direction by a valve spring 77 and which protrudes with a pressure shoulder 81 into a pressure chamber 75, which is permanently connected via a pressure line 73 to the pressure chamber 49 at the control valve 17; the pressure in the pressure chamber 75 acts on the valve member 79 in the opening direction. An injection conduit 83 leads from the pressure chamber 75 along the valve member 79 to one or several injection openings 85 of the injection valve 15, which are controlled by the sealing face on the tip of the valve member 79 and into the combustion chamber, not shown, of the engine to be fed.

The fuel injection device according to the invention works in the following manner.

The high pressure fuel pump 1 supplies the fuel from the low pressure chamber 5 to the high pressure accumulation chamber 9 and builds up a high fuel pressure in it. This high fuel pressure continues via the high pressure lines 13 into the chambers 19 and into the annular chamber 60 of the individual control valves 17 at the injection valves 15 and also fills the respective pressure storage chambers 19. In the rest state, that is when the injection valve 15 is closed, the adjusting magnet 29 on the control valve 17 is switched off so that the pressure spring 27 holds the valve member 23 with the conical sealing face 31 in contact with the conical valve seat 35 so that the communication is closed between the annular chamber 60, which is under high fuel pressure, and the pressure chamber 49, which is permanently connected to the pressure line 73 to the injection valve 15, and the communication is opened from the pressure chamber 49 to the relief conduit 55.

Should an injection take place at the injection valve 15, the adjusting magnet 29 is supplied with current and moves the valve member 23 of the control valve 17 against the restoring force of the pressure spring 27 until the flat valve sealing face 43 of the valve member 23 contacts the flat valve seat 47. The communication of the pressure chamber 49 is closed to the relief conduit 55 and opened to the pressure line 73 so that the high fuel pressure now extends from the annular chamber 60 via the pressure chamber 49 and the pressure line 73 to the pressure chamber 75 of the injection valve 15 and the injection takes place at the injection openings 85 in a known manner via the lifting of the valve member 79 from its valve seat. The opening motion of the valve member 23 upon the opening of the communication from the high pressure line 13 to the injection valve 15 can be delayed by means of the cross section of the relief conduit 55, via which the fuel that is in the damping chamber 53 at start of the opening motion flows toward the relief chamber 65.

Should the injection come to an end, the adjusting magnet 29 is switched off once again and the pressure spring 27 brings the valve member 23 of the control valve 17, which valve member 23 is also pressure balanced in the open state, back into contact with the conical valve seat 35. The opening cross section at the flat valve seat 47 is opened and the fuel under high pressure is released from the pressure line 73 via the pressure chamber 49, the relief conduit 55, and the cross and longitudinal bores 71, 69 in the valve member 23, into the relief chamber 65, from which the fuel flows via the return line 67 into the low pressure chamber 5.

The course of the pressure relief of the pressure line 73 or of the injection valve 15 is determined by the degree of throttling at the throttle segment 51, whose flow cross section is embodied as at least large enough as to guarantee a rapid decrease in pressure to below the closing pressure of the injection valve 15, and thus a reliable closing of the injection valve 15.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection device for internal combustion engines, having a high pressure fuel pump (1), which supplies fuel from a low pressure chamber (5) to a high pressure accumulation chamber (9), the high pressure accumulation chamber (9) communicates via high pressure lines (13) with at least one injection valve (15) which protrudes into a combustion chamber of the engine to be fed, opening and closing motion of the at least one injection valve is controlled by an electrically triggered control valve (17) disposed in the high pressure line (13) at the at least one injection valve (15), the control valve (17) includes a housing (21) and has a pistonlike valve member (23), which has two valve sealing faces remote from one another, of which a first conical valve sealing face (31) disposed on an annular rib (33) cooperates with a conical valve seat (35) and a second flat valve sealing face (43) disposed on a separate collar (39) cooperates with a flat valve seat (47), which encompasses a encompasses a bore (45), a pressure chamber (49), which is defined between the flat and conical valve seats (47, 35) encompasses the annular rib (33) and collar (39), and a chamber wall in the region of the collar (39) has a slight play between said chamber wall and a circumferential face of the collar (39), which play constitutes a throttle (51), wherein a damping chamber (53) is formed between the flat sealing face (43) on the collar (39) and the flat valve seat (47) when the flat seat valve is open, said chamber (53) communicates with a relief chamber (65) via a relief passage conduit (55), which is formed between the bore (45) and a piston shank (41) of the valve member (23) guided in said bore and which has a narrow cross section and adjoins the flat valve seat (47).

2. The fuel injection device according to claim 1, in which a first annular groove (37) is provided on the valve member (23) between the collar (39) and the annular rib (33), which groove's inner diameter is identical to a diameter of a second annular groove (59), which adjoins the conical valve sealing face (31) of the valve member (23) and which is defined on an end remote from the annular rib (33) by a guide piston part (61) on the valve member (23), which is sealingly guided in a guide bore (63).

3. The fuel injection device according to claim 2, in which an outer diameter of the collar (39) is identical to the outer diameter of the annular rib (33).

4. The fuel injection device according to claim 1, in which a pressure line (73) leads from the pressure chamber (49) to the injection valve (15).

5. The fuel injection device according to claim 2, in which an annular chamber (60) is formed between the valve member (23) and a wall of the guide bore (63) in a region of the second annular groove (59), into which chamber (60) the high pressure line (13) feeds.

6. The fuel injection device according to claim 1, in which the valve member (23) has an axial through bore (69), which has a cross bore (71) intersecting said axial through bore in a region of the relief conduit (55), said cross bore (71) connects the relief conduit (55) to the relief chamber (65), which is defined by a guide piston part (61) and from which a return line (67) leads into the low pressure chamber (5).

7. The fuel injection device according to claim 1, in which at each injection valve (15), an additional pressure storage chamber (19) is provided in the high pressure line (13) between the high pressure accumulation chamber (9) and the control valve (17).

8. The fuel injection device according to claim 7, in which the pressure storage chamber (19) is disposed in the housing (21) of the control valve (17).

9. The fuel injection device according to claim 1, in which the valve member (23) of the control valve (17) is disposed perpendicular to an axis of a valve member (79) of the injection valve (15).

* * * * *